US008333025B2

(12) United States Patent
Peterson et al.

(10) Patent No.: US 8,333,025 B2
(45) Date of Patent: Dec. 18, 2012

(54) BADGE FOR DISPLAYING MULTIPLE AND INTERCHANGEABLE PIECES OF INFORMATION

(75) Inventors: James P. Peterson, Manitowoc, WI (US); Arnold M. Kapitz, Manitowoc, WI (US)

(73) Assignee: Contemporary, Inc., Manitowoc, WI (US)

( * ) Notice: Subject to any disclaimer, the term of this patent is extended or adjusted under 35 U.S.C. 154(b) by 30 days.

(21) Appl. No.: 12/835,648

(22) Filed: Jul. 13, 2010

(65) Prior Publication Data

US 2011/0056100 A1 Mar. 10, 2011

Related U.S. Application Data

(63) Continuation-in-part of application No. 12/794,533, filed on Jun. 4, 2010, now Pat. No. 8,065,825, which is a continuation of application No. 11/616,376, filed on Dec. 27, 2006, now Pat. No. 7,752,782, which is a continuation of application No. 11/001,833, filed on Dec. 2, 2004, now Pat. No. 7,194,828.

(60) Provisional application No. 61/225,119, filed on Jul. 13, 2009.

(51) Int. Cl.
*A44C 3/00* (2006.01)

(52) U.S. Cl. ..... 40/1.5; 40/1.6; 40/600; 40/661.01

(58) Field of Classification Search ..... 40/781, 40/704, 706, 776, 1.5, 1.6, 661.01, 600
See application file for complete search history.

(56) References Cited

U.S. PATENT DOCUMENTS

| | | | | | |
|---|---|---|---|---|---|
| 2,145,296 | A * | 1/1939 | Draper et al. | 40/1.5 |
| 2,793,451 | A * | 5/1957 | Goldsholl | 40/653 |
| 2,837,854 | A * | 6/1958 | Bing et al. | 40/706 |
| 3,215,556 | A * | 11/1965 | Kehr | 428/513 |
| 3,707,053 | A * | 12/1972 | Itano | 40/781 |
| 4,000,570 | A * | 1/1977 | Carmen | 40/1.5 |
| 4,616,435 | A * | 10/1986 | Perfect | 40/6 |
| 5,025,581 | A * | 6/1991 | Polzin | 40/776 |
| 5,134,794 | A * | 8/1992 | Walrath | 40/781 |
| 5,186,566 | A * | 2/1993 | Cameron | 402/79 |
| 6,694,656 | B2 * | 2/2004 | Flodin et al. | 40/781 |
| 7,134,232 | B2 * | 11/2006 | Stravitz | 40/781 |
| 2008/0010887 | A1 * | 1/2008 | Goldman | 40/781 |
| 2008/0190001 | A1 * | 8/2008 | Gabbert | 40/781 |

* cited by examiner

*Primary Examiner* — Casandra Davis
(74) *Attorney, Agent, or Firm* — Michael Best & Friedrich LLP

(57) ABSTRACT

A wearable badge for displaying removable indicia includes a backing having an attachment fastener and defining an indicia portion. The wearable badge also includes a frame defining an opening and having a first frame edge and a second frame edge. The first frame edge is joined to the backing such that the first and second frame edges at least partially surround the indicia portion. The indicia portion is viewable through the opening and the second frame edge is moveable away from the backing to facilitate insertion and withdrawal of indicia between the backing and the frame.

25 Claims, 6 Drawing Sheets

BADGE FOR DISPLAYING MULTIPLE AND INTERCHANGEABLE PIECES OF INFORMATION

CROSS-REFERENCE TO RELATED APPLICATIONS

This application claims the benefit of and priority to U.S. Provisional Patent Application No. 61/225,119, filed Jul. 13, 2009, and is a continuation-in-part of U.S. patent application Ser. No. 12/794,533, filed Jun. 4, 2010, which is a continuation of U.S. patent application Ser. No. 11/616,376, filed Dec. 27, 2006, now U.S. Pat. No. 7,752,782, which is a continuation of U.S. patent application Ser. No. 11/001,833, filed Dec. 2, 2004, now U.S. Pat. No. 7,194,828, the entire contents of each of these applications are hereby incorporated by reference.

FIELD OF THE INVENTION

This invention relates generally to badges and, more particularly, to badges used like a "wearable billboard" for displaying multiple and interchangeable pieces of information.

BACKGROUND OF THE INVENTION

A large number of badges exist in today's marketplace for displaying identification or other indicia thereon. These typical badges include only a single display area with indicia thereon. Such indicia can include a wearer's name, an identification number, other words, names, symbols, graphics, illustrations or pictures. Badges are used in a variety of environments, such as service, retail, employment, military, educational, and meeting environments. They are most commonly attached to a wearer's clothing through a variety of means such as pins or adhesives.

SUMMARY OF THE INVENTION

In some aspects, the invention may provide a wearable badge for displaying removable indicia. The wearable badge includes a backing having an attachment fastener and defining an indicia portion. The wearable badge also includes a frame defining an opening and having a first frame edge and a second frame edge. The first frame edge is joined to the backing such that the first and second frame edges at least partially surround the indicia portion. The indicia portion is viewable through the opening and the second frame edge is moveable away from the backing to facilitate insertion and withdrawal of indicia between the backing and the frame.

In other aspects, the invention may provide a wearable badge for displaying removable indicia and including a backing having an attachment fastener, a frame, and a clear indicia overlay. The backing defines an indicia portion having an indicia portion perimeter. The indicia portion perimeter includes at least a first backing edge and a second backing edge that is substantially opposite the first backing edge. The first backing edge defines a plurality of apertures, and the backing includes a cutout positioned substantially opposite the first backing edge. The frame defines an opening and has a first frame edge and a second frame edge that cooperate to at least partially define a frame perimeter. The frame perimeter substantially corresponds to the indicia portion perimeter. The frame also includes a rear surface and a recess that extends around the opening and that is recessed with respect to the rear surface. The first frame edge includes a plurality of projections, and each projection is configured for insertion into a respective one of the plurality of apertures for joining the frame to the backing. The indicia portion is viewable through the opening. The cutout portion in the backing exposes the rear surface of the frame to facilitate movement of the second frame edge away from the backing plate for insertion and withdrawal of indicia between the backing and the frame. The clear indicia overlay is received by the recess and is positioned between the frame and the backing, the recess and the plurality of projections cooperate to retain the overlay between the frame and the backing.

In other aspects, the invention may provide an article for displaying indicia, the article including a housing, a first indicia bearing member positioned on the housing, and a second indicia bearing member positioned on the housing.

In other aspects, the invention may provide a badge including a housing having a first indicia portion and a second indicia portion, the first and second indicia portions being discrete from one another, a first indicia member attached to the first indicia portion of the housing, and a second indicia member attached to the second indicia portion of the housing, the second indicia different than the first indicia.

In yet other aspects, the invention may provide a method of identifying a wearer and advertising goods or services with a badge, the method including providing a badge including a housing having a first indicia portion and a second indicia portion, attaching a first indicia member to the first indicia portion of the housing, and attaching a second indicia member to the second indicia portion of the housing.

DETAILED DESCRIPTION

Figure 1:
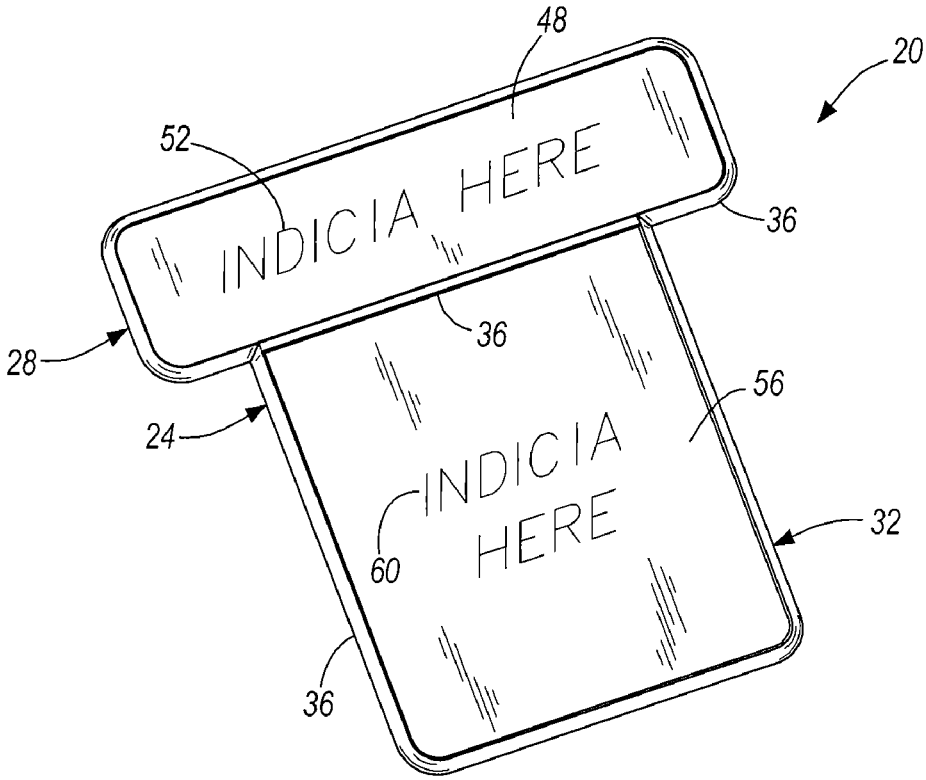
FIG. 1 is a front perspective view of a badge.

With reference to FIG. 1, an article, such as a badge 20, is illustrated and can be worn by a person in various environments, such as, for example a restaurant, a retail store, or by an on-site cable technician, a bus driver, etc., or any other person in an environment in which it is useful for the wearer to display some indicia on his/her person. The indicia, for example, may identify an individual, or advertise, promote or market a service or product. The indicia may comprise, for example, text, pictures, colors, numbers, symbols, illustrations, etc.

Badge 20 includes a housing 24 having a first indicia portion 28 and a second indicia portion 32. The badge 20 can assume a variety of different configurations and can include any number of indicia portions. For example, badge 20 can include three indicia portions. In such an example, one of the indicia portions can be for identification of a person and the other two, for advertising. In the illustrated construction, including only two indicia portions, first indicia portion 28 is used to identify the user of badge 20 and second indicia portion 32 is used for advertising, promoting or marketing purposes to advertise, promote or market a product(s) or service(s). Alternatively, the first indicia portion 28 can be used for advertising, promotional or marketing purposes and the second indicia portion 32 can be used for identification purposes.

Figure 2:
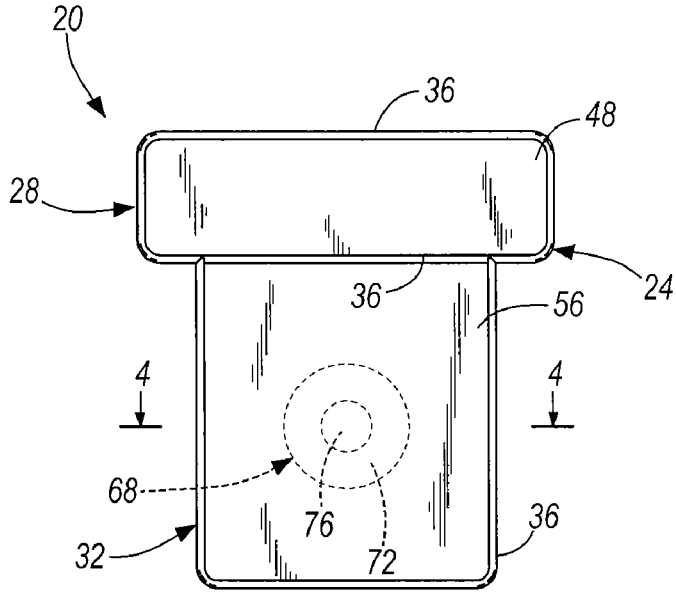
FIG. 2 is a front view of the badge shown in FIG. 1, shown with indicia removed.
Figure 3:
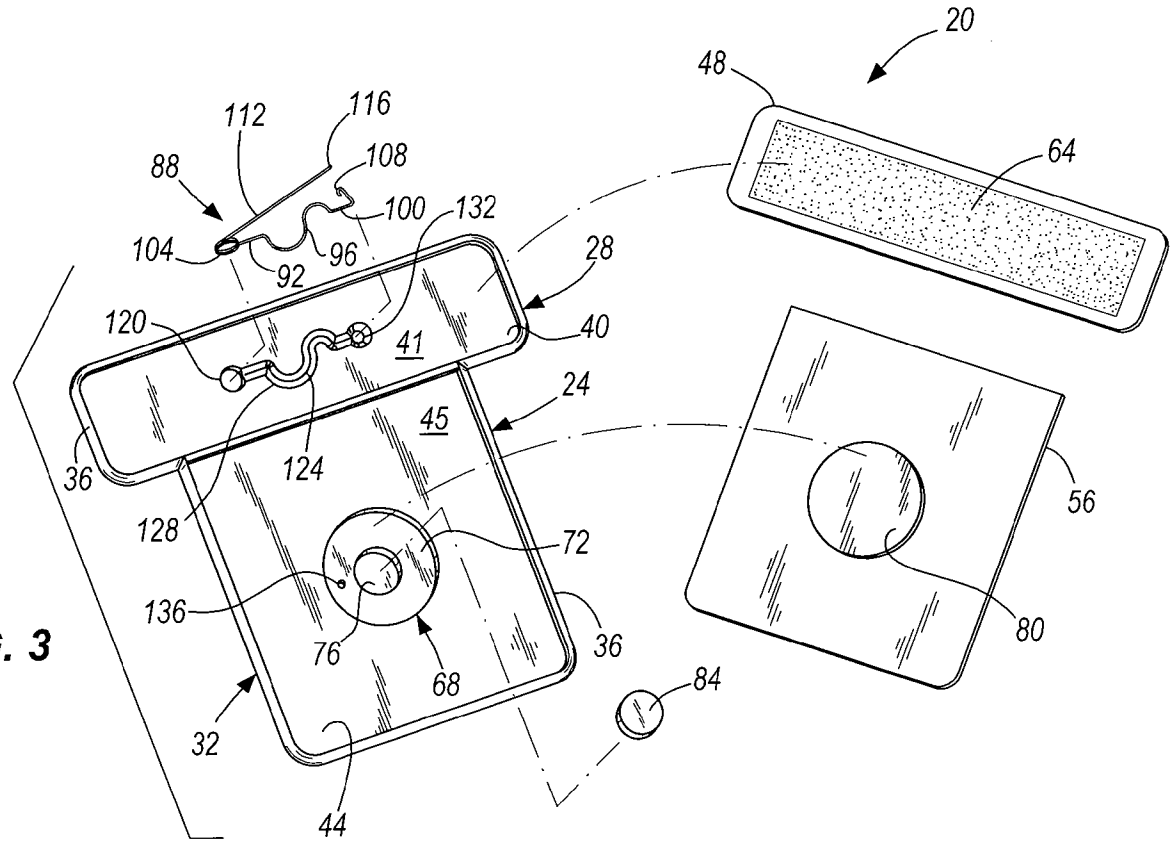
FIG. 3 is an exploded front perspective view of the badge shown in FIG. 1.

With reference to FIGS. 1-4, housing 24 includes a frame 36 extending around and between the first and second indicia portions 28, 32 to discretely separate them and define a first receptacle 40 and a second receptacle 44, corresponding respectively to the first and second indicia portions 28, 32 (see FIG. 3). Badge 20 also includes a first plate 48 containing a first indicia 52 thereon and a second plate 56 containing a second indicia 60 thereon (see FIGS. 1 and 2). The first and second plates 48, 56 are positionable in the first and second receptacles 40, 44, respectively, and are each surrounded by frame 36. The frame 36 assists in proper insertion and alignment of the plates 48, 56 in the first and second receptacles 40, 44 because the plates preferably substantially fill the area, but not necessarily the depth, of the respective receptacles.

Figure 4:
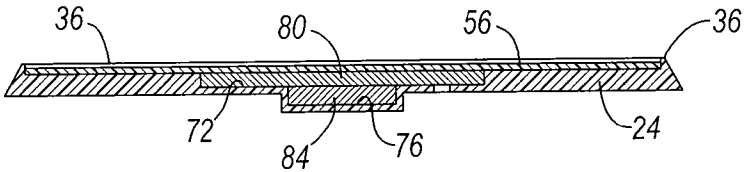
FIG. 4 is a cross-sectional view taken along line 4-4 in FIG. 2.

Referring to FIGS. 2-4, the plates 48, 56 can be either removably or permanently attached to housing 24 within the receptacles 40, 44 in a variety of manners. In the illustrated construction, double-sided adhesive tape 64 is applied to the rear of the first plate 48, which is adhesively attached to floor 41 within the first receptacle 40. In this manner the first plate 48 is removably and adhesively attached to housing 24 and can be removed from the housing 24 to attach another plate to the housing 24 within the first receptacle 40 or for other reasons (discussed in more detail below). Alternatively, the adhesive tape 64 could include the appropriate adhesive properties to permanently attach the first plate 48 to the housing 24, thereby preventing the first plate 48 from being removed and replaced with another plate.

Also in the illustrated construction, the second plate 56 is magnetically attached to the second receptacle 44. A stepped recess 68 is defined in the floor 45 within the second receptacle 44 and includes a first step 72 and a second step 76 concentric with the first step position (see FIGS. 3 and 4). First step 72 lies below floor 45 and second step 76 lies below first step 72. Badge 20 further includes a metallic member 80 capable of magnetic attraction connected to the rear of the second plate 56 and a magnet 84 connected to the housing 24 within the second step 76 of the stepped recess 68. To removably and magnetically attach the second plate 56 to the housing 24, the metallic member 80 is aligned with and fits within the first step 72 of the stepped recess 68, where the magnet 84 magnetically attracts the metallic member 80 thereto and magnetically attaches the second plate 56 to the housing 24. In the illustrated construction, the metallic member 80 and the first step 72 of the stepped recess 68 are complimentarily shaped to assist, in combination with the frame 36, with obtaining the proper orientation and attachment of the second plate 56 to the housing 24. The metallic member 80 and the first step 72 of the stepped recess 68 can assume any appropriate shape, either complimentary or uncomplimentary to each other, so long as the member 80 and magnet 84 can magnetically connect and the second plate 56 lies flat against floor 45. That is, the depths of the first and second steps and the corresponding thicknesses of member 80 and magnet 84 must be such as to permit second plate 56 to lie flush with floor 45. Also, the magnet 84 and the metallic member 80 can be reversed with one another and connected to the other of the second plate 56 and the second step 76 of the stepped recess 68. The magnet 84 and metallic member 80 can be of any shape or size as long as a secure magnetic attachment is made therebetween and maintained during normal use of the badge 20.

The first and second plates 48, 56 can be connected, either permanently or removably, to the housing 24 within the appropriate receptacle 40, 44 in a variety of other manners, such as, for example, gluing, hooks and loop fasteners (Velcro), permanently bonding (i.e., melting), integrally forming, suitable combinations of connecting systems, etc. It should further be understood that the first and second plates 48, 56 can be similarly attached (i.e., both adhesively attached or both magnetically attached) or differently attached (i.e., as illustrated in the figures and described hereinbefore) to the housing 24.

Figure 5:
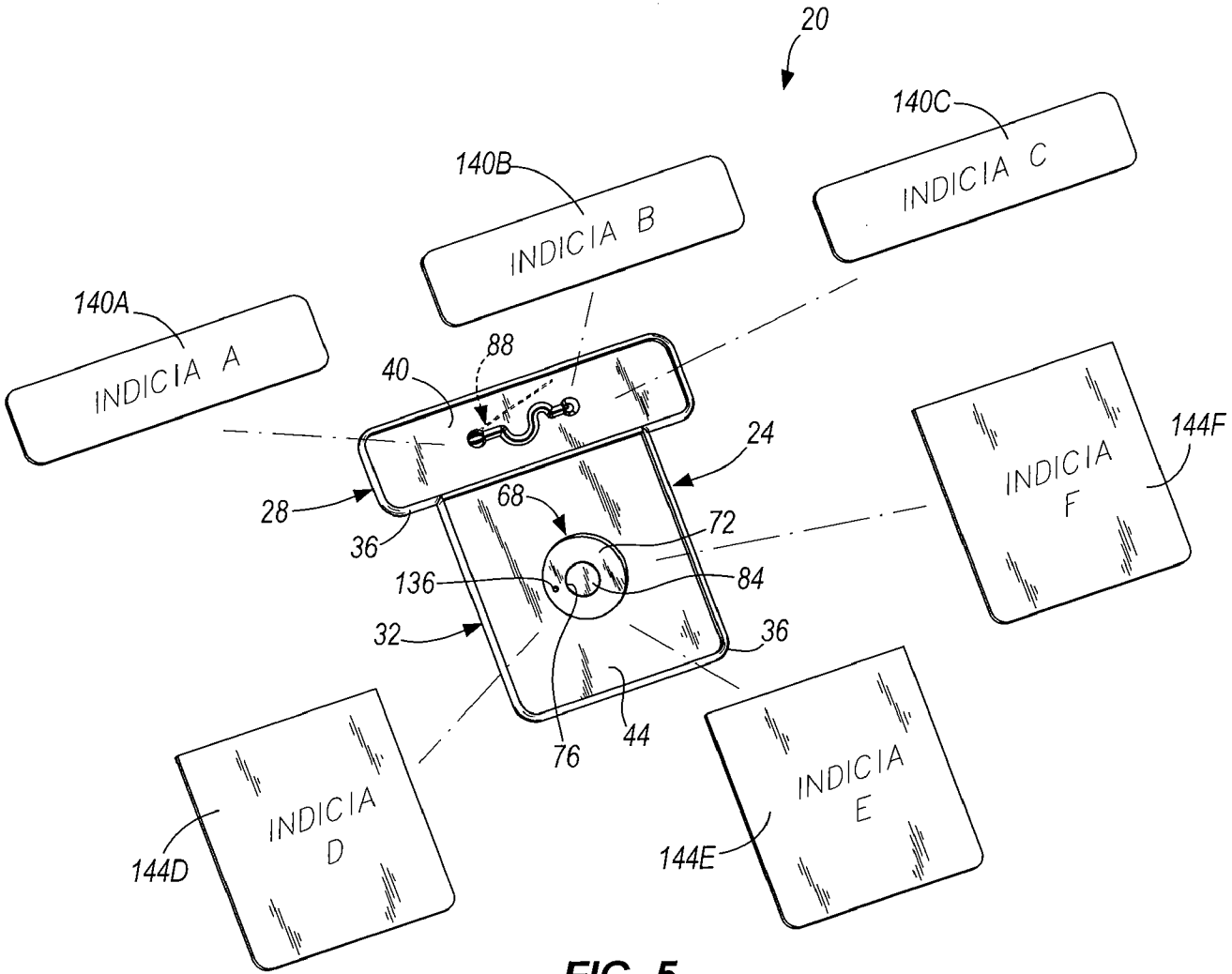
FIG. 5 is an exploded front perspective view of the badge shown in FIG. 1, shown with a plurality of indicia plates exploded from the badge.
Figure 6:
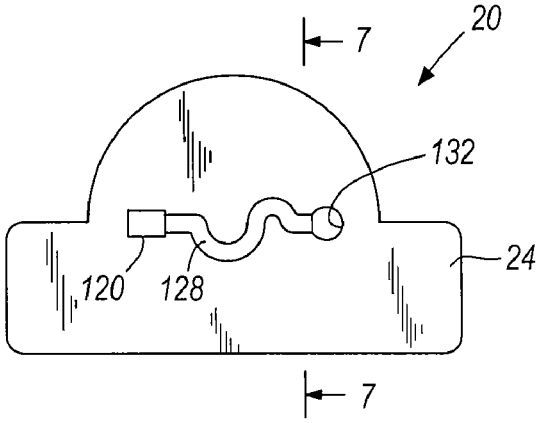
FIG. 6 is a front perspective view of a badge.
Figure 9:
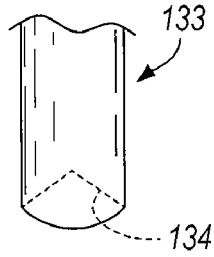
FIG. 9 is a side view of the punch shown in FIGS. 7 and 8.
Figure 7:
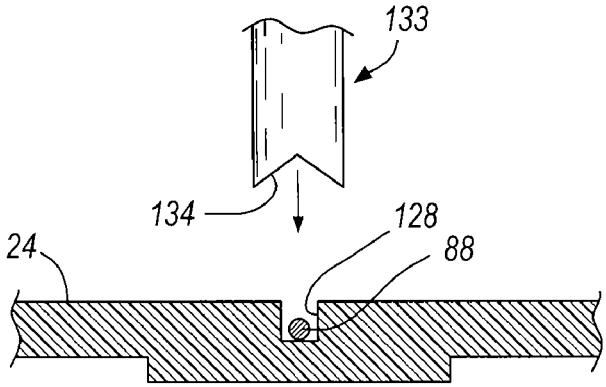
FIG. 7 is a cross-sectional view of the badge taken along line 7-7 in FIG. 6, shown with a punch before it engages the badge.
Figure 8:
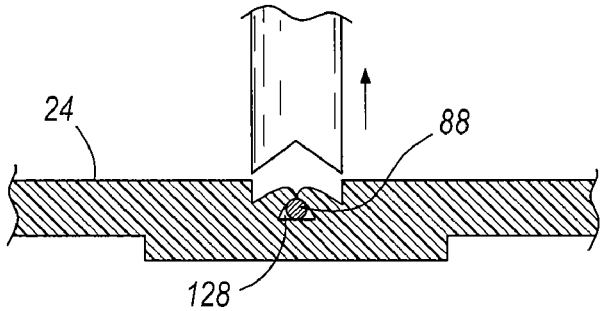
FIG. 8 is a cross-sectional view similar to the cross-sectional view in FIG. 7, shown with the punch after it engages the badge.

Referring particularly to FIGS. 3 and 5, badge 20 includes a pin 88 for attaching badge 20 to clothing of a worker. Pin 88 is formed by bending a wire spring. The pin 88 has a bent profile 92-100 in a horizontal plane and an upstanding spring bend 104 and a hook 108 in a vertical plane. Pin 88 also has a bar 112, pointed on one end 116, which may be inserted through any suitable fabric in order to attach badge 20 to the clothing of a person. At bend 104, the wire spring bends back upon itself to form a spring section, which is reminiscent of a corresponding part of a safety pin. From there, the wire spring has a profile in a horizontal plane and the profile preferably begins with a somewhat straight section 92. The straight section 92 facilitates installation of the pin 88 through a hole 120 defined through the housing 24 in the first receptacle 40. Next, the wire spring forming the pin 88 has an arcuate stabilizing section 96 in a horizontal plane. The arcuate stabilizing section 96 of the pin 88 is similar in shape to an arcuate stabilizing section 124 of a groove 128 defined in the floor 41 of first receptacle 40 of the housing 24. It should be understood that the arcuate stabilizing section 96 of the pin 88 and the groove 128 can have a variety of configurations, as long as the configurations are sufficient to stabilize the pin 88 relative to the housing 24. At the end of the arcuate stabilizing section 96, the wire spring has a straight section 100, again to facilitate insertion of hook 108 through a second hole 132 in the housing 24. The wire spring ends in upstanding hook 108 for receiving and capturing end 116 of bar 112. Attaching the first plate 48 to the housing 24 within the first receptacle 40 secures the pin 88 to the housing 24. Removal of the first plate 48 from the housing 24 allows the pin 88 to be removed from the housing 24.

When the badge 20 is repeatedly attached and removed from the user's clothing, sometimes the pin 88 may form an undesirable impression on the face of first plate 48 caused by the pin's movement relative to the groove 128 in the housing 24. To avoid this from occurring, the pin 88 may be glued or otherwise secured in place so that it will not move during use of the badge 20. When the pin 88 is glued in the groove 128, the pin 88 will not normally be removable.

While gluing is a suitable means for securing the pin in place, it is a labor-intensive step, which is costly. Referring to FIGS. 6-9, another means of securing involves wedging a portion of the plastic material of the housing 24 adjacent the groove 128 over the pin 88 after the pin 88 is placed in groove 128. Wedging the material over the pin 88 secures or pinches the pin 88 in place and prevents the pin 88 from moving within the groove 128. The wedging operation is performed with a punch 133 that includes a tip 134 appropriately shaped to force plastic material of the housing 24 over the pin 88 to secure the pin 88 in the groove 128. The tip 134 can be a variety of shapes as long as the pin 88 is properly wedged within the groove 128. The punch 133 moves toward the housing 24 and the tip 134 engages a portion of the housing 24 on each side of the pin 88 to force a suitable portion of the material of the housing 24 over the pin 88 to secure or pinch the pin 88 within the groove 128. After the punch 133 travels sufficiently toward the housing 24 to secure the pin 88 within the groove 128, the punch 133 moves away from the housing 24 in preparation for the next operation.

Badge 20 can be attached to the wearer's clothing in other ways. For example, badge 20 could be attached by a snap, a clip, a jump ring, hook and loop fasteners, magnetically, a military fastener using a nail and a clutch, a pendant, or the like.

Referring to FIGS. 3 and 4, an aperture 136 is defined in the first step 72 of the stepped recess 68. The aperture 136 allows an object (not shown), such as, for example a pen, a pencil, or any other appropriately sized tool, to insert therethrough and engage and push the metallic member 80, together with the second plate 56 away from the magnet 84. In this way the second plate 56 can be easily removed from the housing 24. In the illustrated construction, the aperture 136 is defined in the first step 72 of the stepped recess 68; however, the aperture 136 can be located elsewhere on the housing 24 so long as a suitable object can be inserted therethrough to engage the second plate 56 and push it away from the housing 24. A similar aperture can be provided in the first indicia portion 28 of the housing 24 to facilitate removal of plate 48 from the first indicia portion 28 of the housing 24 in those instances where the plate 48 is removably attached to the housing 24.

Referring to FIG. 5, badge 20 can receive a plurality of identification plates 140 and a plurality of advertising plates 144, which are removably attached and thereby selectively interchangeable by the user.

For example, person A having his or her name on the identification plate 140A can attach identification plate 140A to the first indicia portion 28 and can attach advertising plate 144D to the second indicia portion 32. The following day, person A can remove advertising plate 144D from the housing 24 and attach advertising plate 144E to the housing 24. Indicia D and E may be different forms of advertising for the same product or advertising for different products. In this example, badge 20 is used to identify the same person and the advertising plates 144 are interchangeable to change the advertising performed by badge 20.

In another example, several people can use the badge 20 to advertise the same product. In such an example, identification plate 140A can be attached to the housing 24 for person A and advertising plate 144F can be attached to the housing 24. If person B needs to use the badge 20, person B removes identification plate 140A from the housing 24 and attaches identification plate 140B to the first indicia portion 28. Advertising plate 144F remains attached to the housing 24 and, therefore, person B is advertising the same product as person A using the same badge 20. Any member of suitable combinations can be achieved among several people according to the desires and needs of the employers of these people.

In yet another example, multiple workers can use badge 20 to advertise a plurality of advertisements. This example is a combination of the two previously explained examples in that the identification plates 140 are interchanged between two workers and the advertising plates 144 are interchanged to advertise various advertisements.

Figure 10:
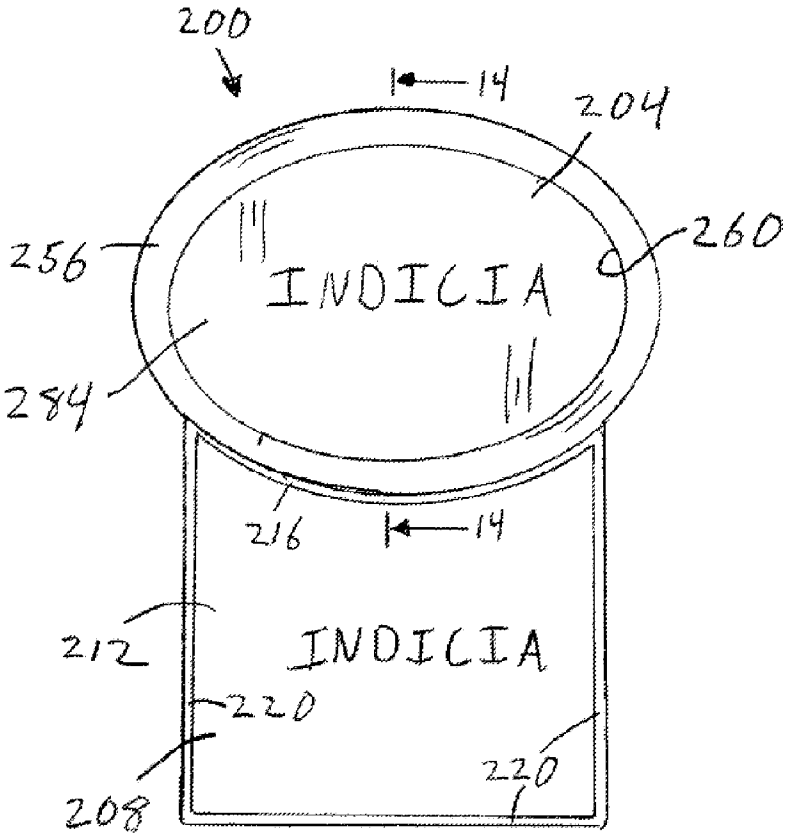
FIG. 10 is a front view of an alternative badge.
Figures 11, 12, 13:
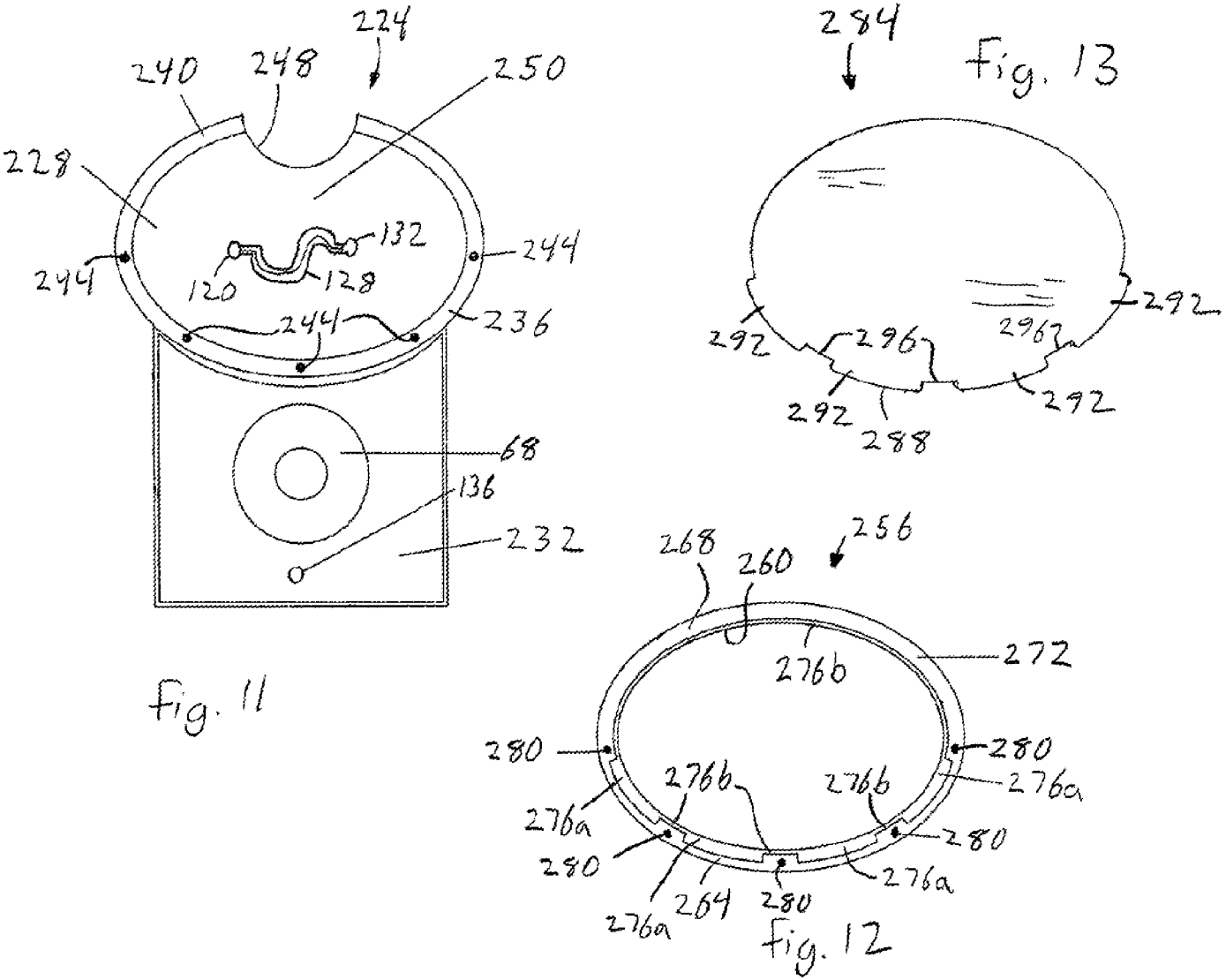
FIG. 11 is a front view of a backing of the badge shown in FIG. 10.
FIG. 12 is a rear view of a frame of the badge shown in FIG. 10.
FIG. 13 is a front view of a clear indicia overlay of the badge shown in FIG. 10.

With reference to FIGS. 10 and 11, an alternative article, such as a badge 200, is customizable and reusable and includes a first indicia portion 204 and a second indicia portion 208. In the illustrated embodiment, the second indicia portion 208 is configured similarly to the second indicia portion 32 of the badge 20 illustrated in FIGS. 1-5, and includes a stepped recess 68 for holding magnet 84 (not shown in FIG. 11). Indicia 212 is configured for placement in the second indicia portion 208 and has mounted to a rear surface thereof a metallic plate (not shown) that is attracted to the magnet 84 for removably securing the indicia 212 within the second indicia portion 208, as discussed above with respect to the embodiment of FIGS. 1-5. Second indicia portion 208 also includes an aperture 136 that allows an object to be inserted therethrough from the rear of the badge 200 to push the indicia 212 away from the second indicia portion 208 to facilitate removal and replacement of the indicia 212 for various purposes. In this regard, attaching and removing indicia 212 to/from the second indicia portion 208 involves moving the indicia in a direction substantially perpendicular to a plane defined by the second indicia portion 208.

The illustrated second indicia portion 208 includes a curved upper edge 216 and straight side and bottom edges 220. It should be appreciated, however, that the second indicia portion 208 can be substantially any desired shape. Furthermore, in some embodiments, the badge 200 may include only the first indicia portion 204, with the second indicia portion 208 being eliminated. In still other embodiments, the second indicia portion 208 of the embodiment of FIGS. 10-14 may be configured similarly to the first indicia portion 28 of the embodiment of FIGS. 1-5, in which case the indicia (not shown) may be attached to the second indicia portion 208 by adhesive. The various alternative configurations and arrangements and discussed above with respect to the second indicia portion 32 may also be incorporated or applied to the second indicia portion 208.

As illustrated in FIG. 11, the badge 200 includes a backing 224 including an upper portion 228 that corresponds to the first indicia portion 204 and a lower portion 232 that corresponds to the second indicia portion 208. The lower portion 232 includes the recess 68 and the aperture 136 discussed above. The upper portion 228 includes an arcuate first backing edge 236 that defines a lower boundary of the first indicia portion 204 and an arcuate second backing edge 240 that defines an upper boundary of the first indicia portion 204. The first and second backing edges 236, 240 cooperate to define a first indicia portion perimeter. In the illustrated embodiment, the first indicia portion perimeter is substantially oval-shaped. In other embodiments, the first indicia portion perimeter may be differently shaped (e.g., rectangular), and may be further defined by additional straight or arcuate edges other than the first and second backing edges 236, 240. In the illustrated embodiment, the upper portion 228 defines apertures 120, 132 and a groove 128 similar to those discussed above with respect to the badge 20 to facilitate attachment of an attachment fastener in the form of a pin 88 (see FIG. 3) to the upper portion 228. The pin 88 may be attached to the upper portion 228 by the staking process described above and illustrated in FIGS. 7-9, and is provided to facilitate attachment of the badge 200 to an article of clothing.

The lower, first backing edge 236 defines a plurality of spaced-apart apertures 244 (e.g., five apertures) extending along the sides and bottom of the upper portion 228. The upper portion 228 defines a generally semi-circular cutout 248 that, in the illustrated embodiment, substantially bisects the upper, second backing edge 240. The first and second backing edges 236, 240 are raised slightly relative to the remainder of the upper portion 228 and define a shallow recess 250 into which an indicia card 252 fits (see FIG. 14).

With reference to FIG. 12, the badge 200 also includes a frame 256 that is joined to the backing 224 and that supports and maintains the indicia 252 within the first indicia portion 204. The frame 256 is generally oval-shaped and defines an opening 260 through which the indicia 252 is viewed when the frame 256 is joined to the backing 224. The frame 256 includes a lower, first frame edge 264 and an upper, second frame edge 268 that cooperate to define a frame perimeter that substantially corresponds to the indicia portion perimeter. It should be appreciated that in some embodiments the frame perimeter may not correspond to the indicia portion perimeter, and that like the indicia portion perimeter, the frame perimeter may have other shapes (e.g., rectangular) and may be formed by a combination of straight and/or arcuate edges.

The frame 256 includes a rear surface 272 that faces the backing 224 when the frame 256 is joined to the backing 224. The frame 256 also defines a recess 276*a*, 276*b* that extends around the opening 260 and that is recessed with respect to the rear surface 272. In the vicinity of the lower first frame edge 264, the recess 276*a*, 276*b* includes relatively thicker portions 276*a* separated by relatively thinner portions 276*b*. A single relatively thinner portion 276*b* extends along the entire length of the upper, second frame edge 268. The frame 256 also includes a plurality of projections or pins 280 that extend from the rear surface 272. The illustrated frame 256 includes five pins 280 that correspond to, and are configured to be received by, the five apertures 244 spaced along the first backing edge 236. Three of the five pins 280 are generally aligned with respective ones of the three relatively thinner recess portions 276*b* positioned along the lower, first frame edge 264. The other two pins 280 are positioned adjacent the transitions between the outer-most relatively thicker recess portions 276*a* and the single relatively thinner portion 276*b* associated with the second frame edge 268. As a result, each relatively thicker portion 276*a* is bounded by a pair of pins 280.

With reference also to FIG. 13, a clear indicia overlay 284, typically formed of a suitable plastic, is configured for insertion into the recess 276*a*, 276*b* of the frame 256. The illustrated overlay 284 is generally oval shaped and includes a castellated lower edge 288 comprising alternating projections 292 and recesses 296. The projections 292 are sized and shaped to fit within the relatively thicker recess portions 276*a*, and the recesses 296 are sized and shaped to fit within the relatively thinner recess portions 276*b*. When the badge 200 is fully assembled, the indicia 252 is viewed through the overlay 284, which provides a glossy, professional appearance. The castellated configuration of the overlay substantially interlocks with the relatively thicker and thinner recess portions 276*a*, 276*b* such that, when the badge 200 is assembled, the overlay 284 is securely held (e.g., cannot be removed during normal use) between the backing 224 and the frame 256.

Figure 14:
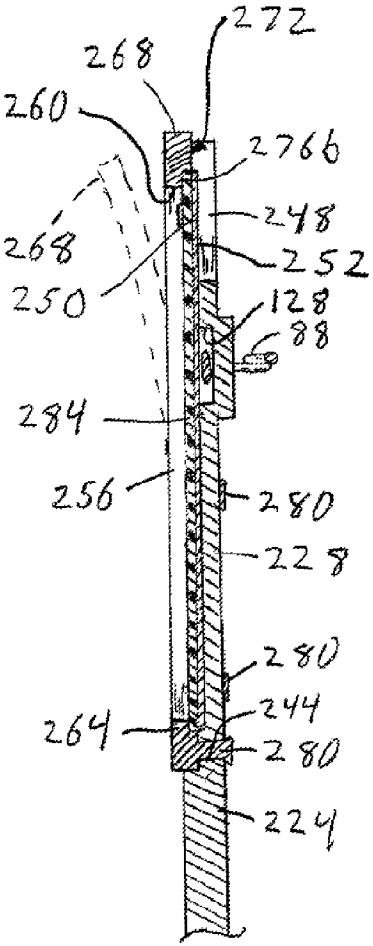
FIG. 14 is a section view taken along line 14-14 of FIG. 10.

With reference also to FIG. 14, the lower, first frame edge 264 is shown joined to the backing 224 by the pins 280. The pins 280 extend through the apertures 244 and are staked, melted, or otherwise deformed to prevent removal of the pins 280 from the apertures 244. In some embodiments, the apertures 244 are chamfered or counter-sunk from the rear of the backing 224 such that the deformed pins do not project beyond the rear surface of the backing 224. Along the upper, second frame edge 268, the cutout 248 exposes both the rear surface 272 of the frame 256 and a portion of the indicia card 252.

The cutout 248 allows a user to position a finger against the exposed portion of the indicia card 252 and slide the indicia card 252 out from between the backing 224 and the frame 256. In this regard, inserting and removing the indicia card 252 involves moving the indicia card 252 in a direction that is substantially parallel to a plane defined by the first indicia portion 204. As shown in phantom lines, the cutout 248 also allows a user to move the second frame edge 268 (e.g., by bending) forwardly and away from the backing 224, thereby relieving some of the pressure applied to the indicia card 252 by the natural resilience of the frame 256, and reducing the amount of force required to remove the indicia card 252 from between the frame 256 and the backing 224. Bending the frame 256 in this manner also simplifies insertion of a replacement indicia card 252 between the frame 256 and the backing 224. The extent of bending of the second frame edge 268 will of course depend upon the force applied by the user and the relative stiffness of the material that makes up the frame 256.

As mentioned above, the overlay 284 is securely held between the backing 224 and the frame 256 by its castellated configuration and the relatively thicker and thinner recess portions 276*a*, 276*b*. The attachment of the pins 280 to the backing 224 by way of the apertures 244 also contributes to securement of the overlay 284 between the backing 224 and the frame 256. Thus, the overlay remains secured between the backing 224 and the frame 256 during removal and replacement of the indicia card 252. Although the illustrated overlay 284 has a substantially uniform cross-section, the overlay 284 may also be configured as a dome, including a relatively thin flange-like section for engagement within the recess 276*a*, 276*b* and a domed portion that extends forwardly into the opening 260 defined by the frame 256.

In some embodiments, the indicia card 252 is opaque and may be printed with whatever indicia is desired, including a corporate logo, an employee name, and the like. In other embodiments, the indicia card 252 may be at least partially transparent and may be printed to include "variable" indicia, while the recess backing 224 is printed to include "permanent" indicia that is viewed through the partially transparent indicia card 252 when the indicia card 252 is positioned between the frame 256 and the backing 224. In this way, a company may order badges having its logo or other relatively unchanging information (e.g., "permanent" indicia) printed on the backing 224, and can then print customized indicia cards 252 having "variable" indicia, such as employee names or information regarding time-limited sales promotions, and the like. Such a configuration may simplify the printing equipment that is used by the customer to produce custom badges, and may also allow for the use of metallic, sparkly, or other specialized finishes on the backing 224 that can be printed by the manufacturer, but which might be difficult to produce using on-site printers, such as those used by customers to print the customized indicia cards 252.

Although particular constructions of the present invention have been shown and described, other alternative constructions will be apparent to those skilled in the art and are within the intended scope of the present invention.

What is claimed is:

1. A wearable badge for displaying removable indicia, the wearable badge comprising:

a backing including an attachment fastener, the backing defining an indicia portion;

a frame defining an opening, the frame having a first frame edge and a second frame edge, the first frame edge permanently joined to the backing such that the first and second frame edges at least partially surround the indicia portion, the indicia portion viewable through the opening and the second frame edge moveable away from the backing to facilitate insertion and withdrawal of indicia between the backing and the frame, wherein the backing includes a cutout and the second frame edge extends across the cutout, and wherein the cutout exposes a rear surface of the frame to facilitate bending the second frame edge away from the backing.

2. The badge of claim 1, wherein the backing defines an indicia portion perimeter, and the first and second frame edges cooperate to at least partially define a frame perimeter that substantially corresponds to the indicia portion perimeter.

3. The badge of claim 1, wherein the backing includes a first backing edge and a second backing edge substantially opposite the first backing edge and wherein the first frame edge is substantially aligned with and joined to the first backing edge and the second frame edge is substantially aligned with and bendable away from the second backing edge.

4. The badge of claim 1, wherein the backing defines a plurality of apertures along a first backing edge and the frame defines a plurality of projections along the first frame edge, each of the plurality of projections configured for insertion into a respective one of the plurality of apertures for joining the frame to the backing.

5. The badge of claim 4, further comprising a clear indicia overlay positioned between the frame and the backing, wherein the plurality of projections cooperate to retain the overlay between the frame and the backing.

6. The badge of claim 1, further comprising a clear indicia overlay positioned between the frame and the backing, wherein the frame includes a rear surface that faces the backing when the frame is joined to the backing, the frame defining a recess that extends around the opening and is recessed with respect to the rear surface, the recess sized and shaped to receive the clear indicia overlay.

7. The badge of claim 1, wherein the indicia portion is a first indicia portion, the badge further comprising a second indicia portion positioned adjacent the first indicia portion.

8. The badge of claim 7, wherein the first and second indicia portions display indicia in substantially parallel planes, and wherein the first indicia portion receives indicia in a direction that is substantially parallel to the planes, and the second indicia portion receives indicia in a direction that is substantially perpendicular to the planes.

9. A wearable badge for displaying removable indicia, the wearable badge comprising:

a backing including an attachment fastener, the backing defining an indicia portion having an indicia portion perimeter including at least a first backing edge and a second backing edge substantially opposite the first backing edge, the first backing edge defining a plurality of apertures, the backing including a cutout positioned substantially opposite the first backing edge;

a frame defining an opening, the frame having a first frame edge and a second frame edge that at least partially define a frame perimeter that substantially corresponds to the indicia portion perimeter, the frame including a rear surface and a recess that extends around the opening and is recessed with respect to the rear surface, the first frame edge including a plurality of projections, each projection configured for insertion into a respective one of the plurality of apertures for joining the frame to the backing, the indicia portion viewable through the opening and the cutout portion in the backing exposing the rear surface of the frame to facilitate movement of the second frame edge away from the backing plate for insertion and withdrawal of indicia between the backing and the frame; and a clear indicia overlay received by the recess and positioned between the frame and the backing, the recess and the plurality of projections cooperating to retain the overlay between the frame and the backing.

10. A wearable badge for displaying removable indicia, the wearable badge comprising:

a backing including an attachment fastener, the backing defining an indicia portion;

a frame defining an opening, the frame having a first frame edge and a second frame edge, the first frame edge joined to the backing such that the first and second frame edges at least partially surround the indicia portion, the indicia portion viewable through the opening and the second frame edge moveable away from the backing to facilitate insertion and withdrawal of indicia between the backing and the frame, wherein the backing defines a plurality of apertures along a first backing edge and the frame defines a plurality of projections along the first frame edge, each of the plurality of projections configured for insertion into a respective one of the plurality of apertures for joining the frame to the backing.

11. The badge of claim 10, wherein the backing defines an indicia portion perimeter, and the first and second frame edges cooperate to at least partially define a frame perimeter that substantially corresponds to the indicia portion perimeter.

12. The badge of claim 10, wherein the backing includes a cutout and the second frame edge extends across the cutout, and wherein the cutout exposes a rear surface of the frame to facilitate bending the second frame edge away from the backing.

13. The badge of claim 10, wherein the backing includes a second backing edge substantially opposite the first backing edge and wherein the first frame edge is substantially aligned with and joined to the first backing edge and the second frame edge is substantially aligned with and bendable away from the second backing edge.

14. The badge of claim 10, further comprising a clear indicia overlay positioned between the frame and the backing, wherein the plurality of projections cooperate to retain the overlay between the frame and the backing.

15. The badge of claim 10, further comprising a clear indicia overlay positioned between the frame and the backing, wherein the frame includes a rear surface that faces the backing when the frame is joined to the backing, the frame defining a recess that extends around the opening and is recessed with respect to the rear surface, the recess sized and shaped to receive the clear indicia overlay.

16. The badge of claim 10, wherein the indicia portion is a first indicia portion, the badge further comprising a second indicia portion positioned adjacent the first indicia portion.

17. The badge of claim 16, wherein the first and second indicia portions display indicia in substantially parallel planes, and wherein the first indicia portion receives indicia in a direction that is substantially parallel to the planes, and the second indicia portion receives indicia in a direction that is substantially perpendicular to the planes.

18. A wearable badge for displaying removable indicia, the wearable badge comprising:

a backing including an attachment fastener, the backing defining a first indicia portion;

a frame defining an opening, the frame having a first frame edge and a second frame edge, the first frame edge joined to the backing such that the first and second frame edges at least partially surround the first indicia portion, the first indicia portion viewable through the opening and the second frame edge moveable away from the backing to facilitate insertion and withdrawal of indicia between the backing and the frame; and, a second indicia portion positioned adjacent the first indicia portion, wherein the first and second indicia portions display indicia in substantially parallel planes, and wherein the first indicia portion receives indicia in a direction that is substantially parallel to the planes, and the second indicia portion receives indicia in a direction that is substantially perpendicular to the planes.

19. The badge of claim 18, wherein the backing defines a first indicia portion perimeter, and the first and second frame edges cooperate to at least partially define a frame perimeter that substantially corresponds to the first indicia portion perimeter.

20. The badge of claim 18, wherein the backing includes a cutout and the second frame edge extends across the cutout, and wherein the cutout exposes a rear surface of the frame to facilitate bending the second frame edge away from the backing.

21. The badge of claim 18, wherein the backing includes a first backing edge and a second backing edge substantially opposite the first backing edge and wherein the first frame edge is substantially aligned with and joined to the first backing edge and the second frame edge is substantially aligned with and bendable away from the second backing edge.

22. The badge of claim 18, wherein the backing defines a plurality of apertures along a first backing edge and the frame defines a plurality of projections along the first frame edge, each of the plurality of projections configured for insertion into a respective one of the plurality of apertures for joining the frame to the backing.

23. The badge of claim 22, further comprising a clear indicia overlay positioned between the frame and the backing, wherein the plurality of projections cooperate to retain the overlay between the frame and the backing.

24. The badge of claim 18, further comprising a clear indicia overlay positioned between the frame and the backing, wherein the frame includes a rear surface that faces the backing when the frame is joined to the backing, the frame defining a recess that extends around the opening and is recessed with respect to the rear surface, the recess sized and shaped to receive the clear indicia overlay.

25. A wearable badge for displaying removable indicia, the wearable badge comprising:

a backing including an attachment fastener, the backing defining an indicia portion; and a frame defining an opening, the frame having a first frame edge and a second frame edge, the first frame edge permanently joined to the backing such that the first and second frame edges at least partially surround the indicia portion, the indicia portion viewable through the opening and the second frame edge moveable away from the backing to facilitate insertion and withdrawal of indicia between the backing and the frame, wherein the backing defines a plurality of apertures along a first backing edge and the frame defines a plurality of projections along the first frame edge, each of the plurality of projections configured for insertion into a respective one of the plurality of apertures for joining the frame to the backing.

* * * * *